US005121136A

United States Patent [19]

Kawakubo

[11] Patent Number: 5,121,136

[45] Date of Patent: Jun. 9, 1992

[54] RECORDER FOR THERMAL TRANSFER RECORDING OPERATIONS

[75] Inventor: Toshio Kawakubo, Yokohama, Japan

[73] Assignee: Ricoh Company, Ltd., Tokyo, Japan

[21] Appl. No.: 622,645

[22] Filed: Dec. 5, 1990

[30] Foreign Application Priority Data

Mar. 20, 1990 [JP] Japan ..... 2-68462

[51] Int. Cl.[5] ..... B41J 17/06; B41J 17/08; B41J 33/16

[52] U.S. Cl. ..... 346/76 PH; 400/224.1; 400/224.2; 400/232; 400/236; 400/236.2

[58] Field of Search ..... 400/223, 224.1, 224.2, 400/225, 232, 236, 236.1, 236.2, 226; 346/76 PH

[56] References Cited

FOREIGN PATENT DOCUMENTS 0140269 8/1983 Japan ..... 400/232
0240480 11/1985 Japan ..... 400/232
0135773 6/1986 Japan ..... 400/225

*Primary Examiner*—Benjamin R. Fuller
*Assistant Examiner*—Huan Tran
*Attorney, Agent, or Firm*—Oblon, Spivak, McClelland, Maier & Neustadt

[57] ABSTRACT

A recorder has a feeder for feeding a sheet of recording paper and an ink sheet wound around a circumferential face of a winding member from a supplying roller portion between a recording head and a platen in a state in which the ink sheet overlaps with the sheet of recording paper and a relative feed speed ratio of the sheet of recording paper to the ink sheet is set to be greater than one; and a device for performing a thermal transfer recording operation with respect to the sheet of recording paper through the ink sheet, the winding member being rotated by a rotary driving source rotating at a constant speed, the rotary driving source being adapted to determine a feed speed of the ink sheet. A feeding amount of the ink sheet is smaller than that of the sheet of recording paper.

4 Claims, 2 Drawing Sheets

RECORDER FOR THERMAL TRANSFER RECORDING OPERATIONS

BACKGROUND OF THE INVENTION

1. Field of the Invention

The present invention relates to a recorder in which a sheet of recording paper and an ink sheet wound around a circumferential face of a winding member from a supplying roller portion are fed between a recording head and a platen in a state in which the ink sheet overlaps with the sheet of recording paper and a relative feed speed ratio of the sheet of recording paper to the ink sheet is set to be greater than one, thereby performing a thermal transfer recording operation with respect to the sheet of recording paper through the ink sheet.

2. Description of the Related Art

In a general known recorder, ink of an ink sheet is selectively melted or sublimed by a thermal head, a recording head through which an electric current flows, etc., thereby forming a recording image on a sheet of recording paper.

In the recorder of this type, a feed speed of the ink sheet is set to be lower than that of the sheet of recording paper so as to efficiently use the ink sheet as much as possible and reduce running cost. Such a recorder is shown in Japanese Patent Publication (KOKOKU) No. 62-58917. In this recorder, it is possible to efficiently use the ink sheet so that a using amount of the ink sheet can be reduced and economical efficiency of the ink sheet can be improved.

In another recorder, the ink sheet and the sheet of recording paper are fed in a state in which a relative feed speed ratio of the sheet of recording paper to the ink sheet is greater than one. The feed speed of the ink sheet is determined by using a capstan roller. Such a recorder is shown in Japanese Patent Application Laying Open (KOKAI) No. 63-165169, etc.

The capstan roller is rotated at the above relative feed speed ratio and feeds the ink sheet intermittently or continuously in cooperation with a driven pinch roller. When this capstan roller is irregularly rotated or a slip is caused between the capstan roller and the ink sheet, the ink sheet is irregularly fed so that image density becomes irregular and there is a fear that the quality of an image is reduced.

Therefore, the general recorder has an ink sheet feeding means additionally having a function in which the above irregular rotation of the capstan roller and the above slip are not easily caused. However, in such a case, the construction of the recorder is complicated and the entire recorder is large-sized.

SUMMARY OF THE INVENTION

It is therefore an object of the present invention to provide a recorder in which the feed speed of an ink sheet is substantially determined by a driving source of the ink sheet on a winding side thereof so that the ink sheet and a sheet of recording paper are not easily fed irregularly and the recorder can be made compact.

The above object of the present invention can be achieved by a recorder comprising means for feeding a sheet of recording paper and an ink sheet wound around a circumferential face of a winding member from a supplying roller portion between a recording head and a platen in a state in which the ink sheet overlaps with the sheet of recording paper and a relative feed speed ratio of the sheet of recording paper to the ink sheet is set to be greater than one; and means for performing a thermal transfer recording operation with respect to the sheet of recording paper through the ink sheet, the winding member being rotated by a rotary driving source rotating at a constant speed, the rotary driving source being adapted to determine a feed speed of the ink sheet.

In accordance with the above structure, the feed speed of the ink sheet is substantially determined by the driving source of the ink sheet on a winding side thereof so that the ink sheet and the sheet of recording paper are not easily fed irregularly and the recorder can be made compact.

Further objects and advantages of the present invention will be apparent from the following description of the preferred embodiments of the present invention as illustrated in the accompanying drawings.

DESCRIPTION OF THE PREFERRED EMBODIMENTS

The preferred embodiments of a recorder in the present invention will next be described in detail with reference to the accompanying drawings.

Figure 1:
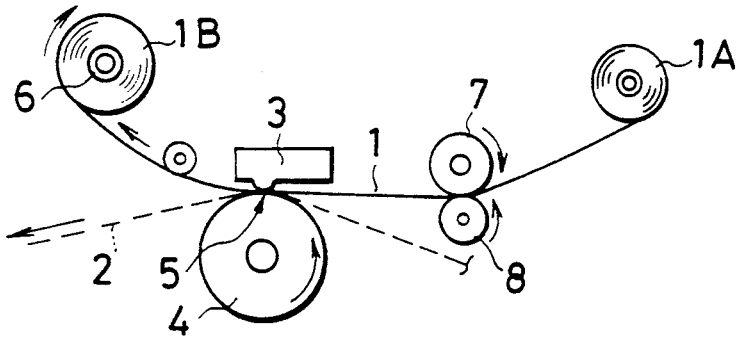
FIG. 1 is a constructional view schematically showing one example of a general recorder.

FIG. 1 shows one constructional example of a general recorder. In this recorder, an ink sheet 1 and a sheet of recording paper 2 are fed intermittently or continuously in respective directions shown by arrows. A thermal transfer recording operation is performed between a thermal head 3 as one constructional example of a recording head and a platen 4 in the shape of a roller.

The ink sheet is fed from a supplying roller portion 1A. While the ink sheet overlaps with the sheet of recording paper 2 in a printing section 5 the ink sheet is sequentially wound around a circumferential face of a cylindrical spool 6 as one constructional example of a winding member.

While the sheet of recording paper 2 is fed through driving motor means or equivalent means known to those in the art by a feeding amount on one line, the ink sheet 1 is fed by a feeding amount 1/N times the feeding amount of the sheet of recording paper 2 where N is a number greater than one. Namely, when a feed speed of the sheet of recording paper 2 is set to Vk and a feed speed of the ink sheet 1 is set to Vi, a relative feed speed ratio Vk/Vi of the sheet of recording paper to the ink sheet is set to be greater than one. Therefore, it is possible to reduce consumption of the ink sheet in comparison with a case in which the relative feed speed ratio is set to one. A recorder for performing a thermal transfer recording operation by such a feeding system is called a recorder in an n-multiple mode.

The ink sheet 1 and the sheet of recording paper 2 are fed at the above relative feed speed ratio. The feed speed of the ink sheet 1 is determined by using a capstan roller 7 as shown in Japanese Patent Application Laying Open (KOKAI) No. 63-165169, etc.

The capstan roller 7 is rotated at the above relative feed speed ratio and feeds the ink sheet 1 intermittently or continuously in cooperation with a driven pinch roller 8. When this capstan roller is irregularly rotated or a slip is caused between the capstan roller and the ink sheet, the ink sheet is irregularly fed so that image density becomes irregular and there is a fear that the quality of an image is reduced.

Therefore, the general recorder has an ink sheet feeding means additionally having a function in which the above irregular rotation of the capstan roller and the above slip are not easily caused. However, in such a case, the construction of the recorder is complicated and the entire recorder is large-sized.

Figure 2:
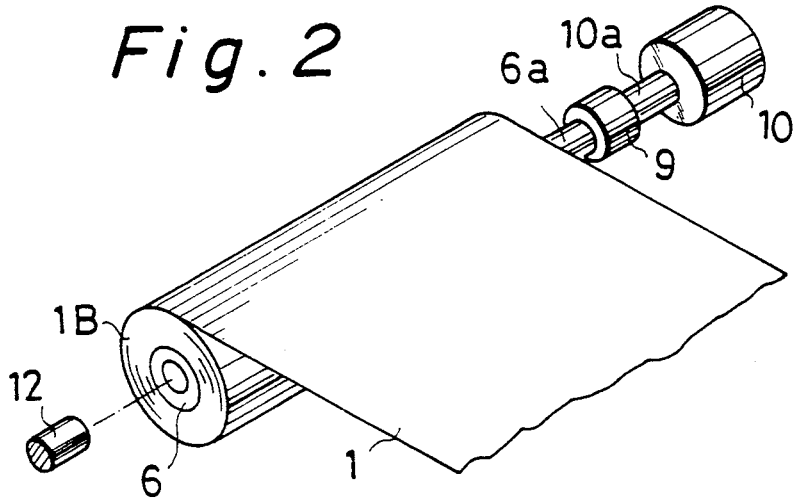
FIG. 2 is a perspective view showing a main portion of a recorder in one embodiment of the present invention.

FIG. 2 shows a recorder in accordance with one embodiment of the present invention.

Figure 3:
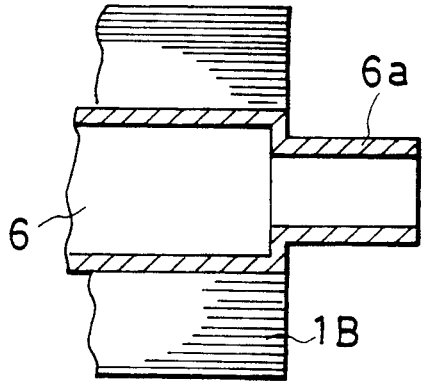
FIG. 3 is a cross-sectional view of a cylindrical spool for winding an ink sheet therearound in the vicinity of a small diameter tubular shaft portion of the spool.

In FIGS. 2 and 3, a small diameter tubular shaft portion 6*a* is integrally formed at one end of a cylindrical spool 6 as one constructional example of a winding member. This small diameter tubular shaft portion 6*a* is connected to a shaft 10*a* of a drive motor 10 through a joint 9. The other end of the cylindrical spool 6 is rotatably supported by a support shaft 12.

Figure 4:
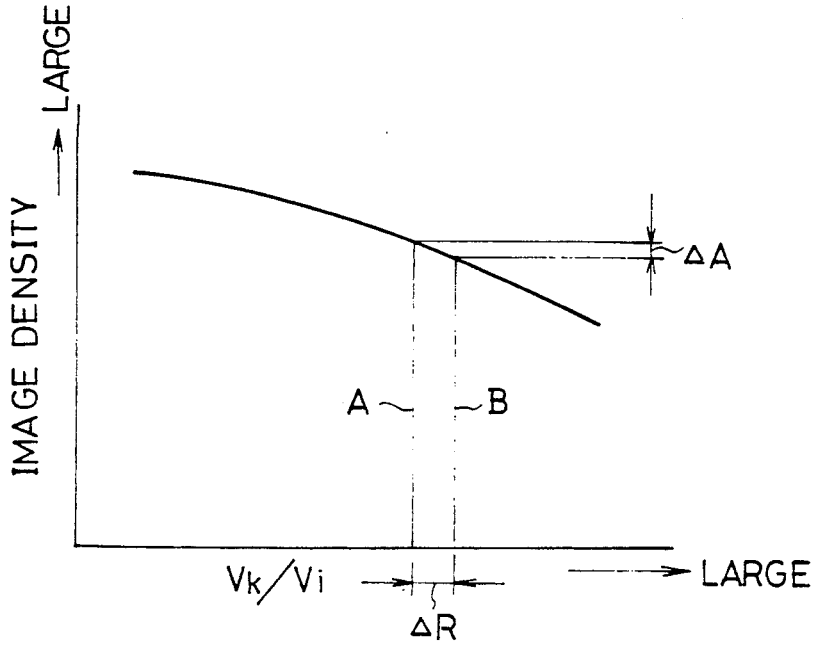
FIG. 4 is a view showing the correlation characteristics between a relative feed speed ratio and an image density.

A feed speed of an ink sheet 1 is set to Vi and a feed speed of a sheet of recording paper 2 is set to Vk. In this case, a relative feed speed ratio Vk/Vi of the sheet of recording paper 2 to the ink sheet 1 is set to be greater than one. FIG. 4 shows the correlation characteristics between the relative feed speed ratio Vk/Vi (>1) and an image density. As shown in FIG. 4, for example, when the relative feed speed ratio Vk/Vi is changed by ΔR at a certain relative feed speed ratio, the image density is changed by ΔA. The relative feed speed ratio and the image density are also changed when the feed speed of the ink sheet 1 is changed.

In the recorder shown in FIG. 1, the capstan roller 7 rotated by a predetermined drive motor is used to substantially determine the feed speed of the ink sheet 1. When the capstan roller 7 is irregularly rotated or a slip is caused between the ink sheet 1 and the capstan roller 7 at the rotating time thereof, the feed speed of the ink sheet 1 is changed so that image density is changed and there is a fear that the image density becomes irregular.

However, in this embodiment, such a capstan roller is not used as a means for substantially determining the feed speed of the ink sheet 1. Namely, the recorder in this embodiment uses a rotary driving source of the ink sheet on a winding side thereof, i.e., the drive motor 10 shown in FIG. 2.

In the recorder in an n-multiple mode, the above relative feed speed ratio is greater than one and a feeding amount of the ink sheet 1 is 1/N times that of the sheet of recording paper 2 where N is a number greater than one. Namely, the feeding amount of the ink sheet is smaller than that of the sheet of recording paper. Therefore, a winding diameter of the ink sheet 1 at the beginning of a winding operation is not different so much from that at the end of the winding operation.

Figure 5:
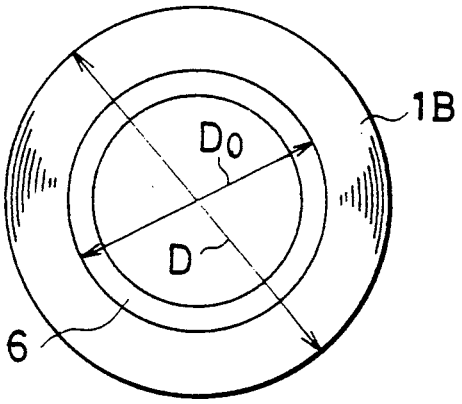
FIG. 5 is a view for explaining an ink sheet roller portion with respect to a roller diameter, etc.

In FIG. 5, reference numeral 1B designates a roller portion around which the ink sheet 1 is wound. Reference numeral D designates a roller diameter at the end of the winding operation of the ink sheet. Reference numeral $D_0$ designates an outer diameter of the cylindrical spool 6.

In the following description, an equal magnification mode is a printing mode when the relative feed speed ration of the sheet of recording paper to the ink sheet is set to one. The length of the ink sheet at a printing time is set to L in the equal magnification mode. The relative feed speed ratio Vk/Vi in the n-multiple mode is set to n. The thickness of the ink sheet is set to t. In this case, the following formula (1) in the equal magnification mode is formed.

$$D^2 - Do^2 = \frac{4\,Lt}{\pi} \tag{1}$$

In contrast to this, the following formula (2) in the n-multiple mode is formed.

$$D^2 - Do^2 = \frac{4\,Lt}{n\pi} \tag{2}$$

In the n-multiple mode, there is number n greater than one in the denominator on the right side of the formula (2) so that the difference between $D^2$ and $D_0^2$ is reduced. Namely, the roller diameter at the beginning of the winding operation with respect to the roller portion 1B is not different so much from that at the end of this winding operation.

When the recorder is assumed to be of a color corresponding type, respective ink layer regions of yellow, magenta and cyan are continuously formed in the ink sheet. In the case of paper size A4, it is assumed that the entire length of these three regions is set to 1 m. When one picture is set in a range of this entire length 1 m and the ink sheet is wound by 100 pictures (L=100 m), the outer diameter $D_0$ is set to 20 mm and the thickness t of the ink sheet is set to about 4 μm. In this case, when the number n is set to 30 in a 30-multiple mode, the roller diameter D is about 20.4 mm from the above formula (2). Namely, a diameter ratio $D/D_0$ is set to 1.2 so that no winding diameter is almost changed.

Since the above diameter ratio is close to one, the feed speed of the ink sheet at the beginning of the winding operation is not different from that at the end of the winding operation when a rotational speed of the drive motor 10 is constant. Accordingly, the change ΔA in image density shown in FIG. 4 is set to be smaller so that no irregular image density is easily caused. Such effects are not obtained in the equal magnification mode since the feeding amount of the ink sheet is equal to that of the sheet of recording paper and the winding diameter of the ink sheet is greatly changed.

Accordingly, in the recorder in an n-multiple mode, it is possible to use the motor 10 for rotating the cylindrical spool 6 so as to substantially determine the feed speed of the ink sheet 1. In this case, this motor may be constructed by a motor rotated at a constant speed instead of a speed change motor. Further, in this embodiment, it is not necessary to dispose the capstan roller 7, the pinch roller 8, etc. shown in FIG. 1.

In FIG. 4, for example, reference numeral B designates a relative feed speed ratio at the beginning of the winding operation. Reference numeral A designates a relative feed speed ratio at the end of the winding operation. In this case, the change ΔR in relative feed speed ratio is reduced so that the change ΔA in image density is very reduced. This means that the difference in image density between first and final sheets of recording paper at a printing time is reduced. In this case, the ink sheet is approximately fed completely at the printing time with respect to the final sheet of recording paper. The diameter ratio $D/D_0$ is set to 1.0002 in the range of one picture. Accordingly, no image density is almost caused and this change in image density lies within a general allowable range of the difference 0.1 in image density.

As mentioned above, in the recorder in an n-multiple mode, it is possible to use a rotary driving source of a winding member such as the cylindrical spool 6 so as to substantially determine the feed speed of the ink sheet. In this case, it is possible to obtain an image having a preferable quality and less irregular image density by the rotary driving source. An important condition is to set the outer diameter $D_0$ such that the difference $\Delta A$ in image density shown in FIG. 4 provides the diameter ratio $D/D_0$ as small as possible.

In the embodiment shown in FIG. 2, the small diameter tubular shaft portion 6*a* is connected to the joint 9, but the present invention is not limited to this structure. For example, another shaft fixed to a tubular end portion of the cylindrical spool 6 may be connected to the joint 9. It is preferable to use a jaw joint as the joint 9 so as to easily detach an ink sheet roller from the joint 9. Further, an unillustrated gear is fixedly disposed in the small diameter tubular shaft portion 6*a* and another shaft portion and may be engaged with another unillustrated gear fixed to the motor shaft 10*a*.

When the recorder is of a color corresponding type, a thermal head of a three head type is used as shown in e.g., Japanese Patent Application No. 1-335316 having the same applicant as this application. Further, it is also possible to apply the present invention to a recorder using a general thermal head of one head type.

As mentioned above, in accordance with the present invention, no slip between a capstan roller and an ink sheet is easily caused although this slip tends to be caused when the capstan roller, etc. are used as an ink sheet feeding means. Accordingly, the ink sheet is stably fed and no irregular image density is caused, or the irregular image density is greatly reduced so that the quality of an image can be greatly improved. Further, it is possible to omit the ink sheet feeding means such as the capstan roller so that the entire construction of the recorder is simplified and the recorder can be made compact.

Many widely different embodiments of the present invention may be constructed without departing from the spirit and scope of the present invention. It should be understood that the present invention is not limited to the specific embodiments described in the specification, except as defined in the appended claims.

What is claimed is:

1. A recorder comprising:

a platen;

a recording head being adapted to interpose a sheet of recording paper and an ink sheet in association with the platen in a state where the ink sheet and the sheet of recording paper overlap with each other, and to perform a thermal transfer recording operation with respect to the sheet of recording paper through the ink sheet;

a feeding means for feeding the sheet of recording paper;

a cylindrical winding member being adapted to wind the ink sheet around a circumferential face thereof; and rotating means connected with the winding member for rotating the winding member at a constant speed thereby to feed the ink sheet in such a manner that a feed speed of the sheet of recording paper is greater than a feed speed of the ink sheet, an angular velocity and a diameter of the winding member being determined in such a manner that a difference in an image density between a beginning of winding and an end of winding is less than 0.1.

2. A recorder as claimed in claim 1, wherein a relative feed speed ratio of the sheet of recording paper to the ink sheet is greater than 20.

3. A recorder as claimed in claim 1, wherein said rotating means includes a driving motor.

4. A recorder comprising:

a platen;

a recording head being adapted to interpose a sheet of recording paper and an ink sheet in association with the platen in a state where the ink sheet and the sheet of recording paper overlap with each other, and to perform a thermal transfer recording operation with respect to the sheet of recording paper through the ink sheet;

a feeding means for feeding the sheet of recording paper;

a cylindrical winding member being adapted to wind the ink sheet around a circumferential face thereof; and a rotating means connected with the winding member for rotating the winding member at a constant speed thereby to feed the ink sheet in such a manner that a feed speed of the sheet of recording paper is greater than a feed speed of the ink sheet, an angular velocity and a diameter of the winding member being determined based on the following equation:

$$f(Vk/Vio)-f(Vk/Vi)<0.1$$

$$Vio=\theta\cdot Do\cdot\pi$$

$$Vi=\theta\cdot D\cdot\pi$$

$$D^2-Do^2=4L\cdot t/n\cdot\pi$$

where f(Vk/Vio) is an image density at a beginning of winding, f(Vk/Vi) is an image density at an end of winding, Vk is the feed speed of the sheet of recording paper, Vio is the feed speed of the ink sheet at a beginning of winding, Vi is the feed speed of the ink sheet at an end of winding, Do is a diameter of the winding member, D is an outer diameter of the ink sheet wound on the winding member at an end of winding, $\theta$ is an angular velocity of the winding member, $\pi$ is the ratio of a circle's circumference to its diameter, n is a relative feed speed ratio Vk/Vi, L is a length of the ink sheet at a printing time, and t is a thickness of the ink sheet.

* * * * *